US010267580B2

(12) United States Patent
Wheatley

(10) Patent No.: US 10,267,580 B2
(45) Date of Patent: Apr. 23, 2019

(54) RIM-FIRE FIREARM RECEIVER WITH CHARGING HANDLE OPPOSITE EJECTION PORT

(71) Applicant: Tactical Innovations Inc., Bonners Ferry, ID (US)

(72) Inventor: Craig Wheatley, Bonners Ferry, ID (US)

(73) Assignee: Tactical Innovations Inc., Bonners Ferry, ID (US)

( * ) Notice: Subject to any disclaimer, the term of this patent is extended or adjusted under 35 U.S.C. 154(b) by 0 days.

(21) Appl. No.: 15/787,103

(22) Filed: Oct. 18, 2017

(65) Prior Publication Data

US 2018/0112939 A1 Apr. 26, 2018

Related U.S. Application Data

(60) Provisional application No. 62/412,430, filed on Oct. 25, 2016.

(51) Int. Cl.

| | |
|---|---|
| ***F41A 35/06*** | (2006.01) |
| ***F41A 3/72*** | (2006.01) |
| ***F41A 3/66*** | (2006.01) |
| *F41A 3/82* | (2006.01) |

(52) U.S. Cl.

CPC ..... *F41A 3/72* (2013.01); *F41A 3/66* (2013.01); *F41A 35/06* (2013.01); *F41A 3/82* (2013.01)

(58) Field of Classification Search

CPC ..... F41A 3/72; F41A 3/66; F41A 3/82; F41A 35/06; F41A 11/02

USPC ..... 89/1.4, 1.42, 128; 42/69.01, 69.02

See application file for complete search history.

(56) References Cited

U.S. PATENT DOCUMENTS

| | | | | | |
|---|---|---|---|---|---|
| 2,296,242 | A * | 9/1942 | Brewer | F41A 3/54 | 42/16 |
| 2,688,203 | A * | 9/1954 | Gaidos | F41A 3/44 | 42/16 |
| 3,225,653 | A * | 12/1965 | Packard | F41A 3/72 | 42/16 |
| 3,341,963 | A * | 9/1967 | Seiderman | F41A 3/20 | 42/16 |
| 3,651,736 | A * | 3/1972 | Ingram | F41A 3/54 | 89/132 |
| 4,020,577 | A * | 5/1977 | Duffy | F41A 3/72 | 42/106 |

(Continued)

*Primary Examiner* — Michael D David

(74) *Attorney, Agent, or Firm* — Wood Herron & Evans LLP

(57) ABSTRACT

A firearm receiver and bolt operating assembly for use in combination with a standard bolt for a semi-automatic rim-fire action of a Ruger 10/22®-pattern firearm. It includes a receiver configured to function with a reciprocating bolt and having an ejection port which does not include a bolt handle opening on a first side and an elongated charging handle slot on a second, opposite side of the receiver. A bolt closure mechanism includes a guide rod, a recoil spring on the guide rod, and an engagement member slidably mounted over the other end of the guide rod. The engagement member is received in a transverse seat of the bolt and provides a bolt handle configured to extend through the slot opposite the ejection port. The spring and rod are inwardly adjacent to the slot and laterally between the handle and the portion received in the seat of the bolt.

3 Claims, 4 Drawing Sheets

(56) References Cited

U.S. PATENT DOCUMENTS 4,515,064 A * 5/1985 Hohrein ..... F41A 11/02 42/49.02
5,722,194 A * 3/1998 Wurger ..... F41A 3/20 42/69.02
6,418,655 B1 * 7/2002 Kay ..... F41A 3/46 42/70.08
6,508,025 B1 * 1/2003 Du Plessis ..... F41A 15/12 42/16
7,240,600 B1 * 7/2007 Bordson ..... F41A 3/72 42/69.01
7,302,881 B1 * 12/2007 Tertin ..... F41A 11/02 42/69.02
7,735,409 B1 * 6/2010 Tertin ..... F41A 3/72 42/69.02
8,381,628 B1 2/2013 Wheatley
9,377,257 B2 * 6/2016 Foster ..... F41A 3/72
9,377,258 B2 * 6/2016 Gomez ..... F41A 3/72
9,482,479 B1 * 11/2016 Jen ..... F41A 3/72
9,541,339 B2 * 1/2017 Orne, III ..... F41A 3/72
D787,005 S * 5/2017 Capps ..... D22/108
9,733,030 B2 * 8/2017 Daniel ..... F41A 3/72
9,976,823 B1 * 5/2018 Pike ..... F41A 3/72
D819,766 S * 6/2018 Farris ..... D22/104
10,012,462 B2 * 7/2018 DeSomma ..... F41A 3/82
10,030,926 B2 * 7/2018 Mather ..... F41A 19/10
10,036,601 B2 * 7/2018 DeSomma ..... F41A 3/66
D825,020 S * 8/2018 Smith ..... D22/108
10,132,589 B1 * 11/2018 Anderson ..... F41A 3/46
2003/0089014 A1 * 5/2003 Schuerman ..... F41A 3/42 42/16
2008/0083319 A1 * 4/2008 Richeson ..... F41A 3/72 89/1.4
2008/0216375 A1 * 9/2008 Barrett ..... F41A 3/66 42/16
2011/0061523 A1 * 3/2011 Webb ..... F41A 3/42 89/128
2015/0233656 A1 * 8/2015 Karagias ..... F41C 23/04 42/16
2016/0238334 A1 * 8/2016 Pflaumer ..... F41A 35/06

* cited by examiner

RIM-FIRE FIREARM RECEIVER WITH CHARGING HANDLE OPPOSITE EJECTION PORT

RELATED APPLICATIONS

This application claims priority to U.S. Provisional Patent Application No. 62/412,430, filed Oct. 25, 2016, and incorporates the same herein by reference.

TECHNICAL FIELD

This invention relates to a receiver upon which a complete rifle or pistol may be built, or which may be a replacement or conversion receiver, for an otherwise standard Ruger 10/22® rifle or Ruger Charger™ pistol. In particular, it relates to a receiver that provides a bolt charging handle on the side opposite the ejection port, but otherwise uses standard Ruger 10/22® and/or Ruger Charger™ bolt and other parts.

BACKGROUND

The Ruger 10/22® rifle, first introduced in 1964, is a very popular semi-automatic rim-fire firearm in .22LR caliber manufactured by Sturm, Ruger & Co. of Southport, Conn. Many others have made variations to the basic rifle, including modified barrels, additional safety mechanisms, modified trigger mechanisms, caliber changes, and modifications to the stock. The bolt and internal dimensions of the 10/22® receiver have remained unchanged and are widely reproduced by third party manufacturers. As a result, 10/22®-pattern "clones" and aftermarket parts and components are widely available.

As used herein, the terms Ruger 10/22® rifle and Charger™ pistol are used interchangeably and to refer to third-party firearms and parts patterned from them. Both the Ruger 10/22® rifle and Charger™ pistol use a functionally identical receiver and include a charging handle which extends laterally from the right side of the receiver through a slot that also acts as the ejection port for spent ammunition casings. Accordingly, it can be awkward at best to manually cycle the action with the user's left hand. A right-handed shooter is not naturally inclined to reach across the rifle and charge the bolt on the right side of the rifle with the left hand. Instead, the user typically must put the rifle in his left hand and operate the charging handle with his right hand, which takes his shooting grip off the rifle each time.

SUMMARY OF THE INVENTION

The present invention provides a receiver upon which a rifle or pistol may be built or which may be used as a replacement receiver and charging handle which can be used with other standard parts of a Ruger® 10/22®-pattern rifle or Charger™-pattern pistol, including the standard bolt, trigger mechanism, barrel, and magazine. The receiver of the present invention provides a charging handle on the side of the receiver opposite the ejection port.

The opposite side location of the laterally-extending charging handle allows the ejection port size to be decreased, since the opening only needs to allow the ejection of spent ammunition casings and does not have to be elongated to accommodate reciprocation of a charging handle. The structure, location, and function of the bolt closure recoil spring and guide rod inside the receiver remain unchanged from the 10/22® pattern. Thus, the spring and guide rod may be viewed and accessed through the opposite side charging handle reciprocation slot for inspection and lubrication. Moreover, because the position of the recoil spring and guide rod are offset from center, the opposite-side position of the handle provides advantageous leverage and reduces lateral loading on the engagement between the handle and the bolt.

Alternatively, the combined ejection port and charging handle opening could be retained on the right side, and a charging handle reciprocation slot added to the opposite side, allowing a charging handle on both sides for ambidextrous operation.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION OF THE INVENTION

Figure 1:
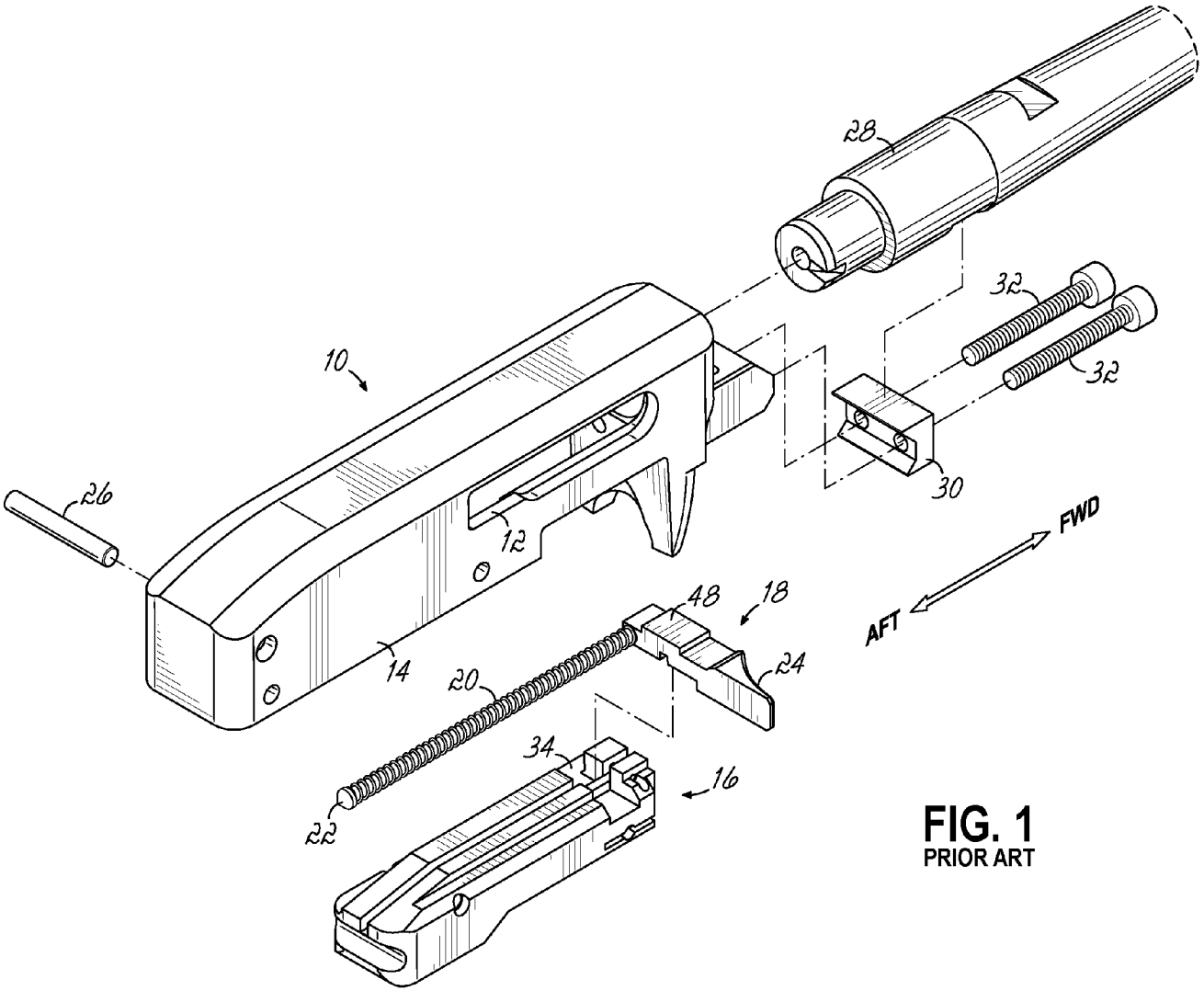
FIG. 1 PRIOR ART
FIG. 1 is an exploded isometric view of a receiver, bolt, recoil spring, charging handle, and barrel according to the prior art Ruger 10/22® firearm.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. As used herein, "longitudinal" refers to a direction parallel to the bore of the firearm barrel, "forward" refers to a direction toward the muzzle end of the barrel, and "aft" refers to a direction toward a stock and away from the muzzle end of the barrel.

Referring first to FIG. 1, therein is shown an isometric exploded view of a standard Ruger 10/22®-pattern receiver 10 with a combined ejection port and charging handle reciprocation slot 12 on the right side wall 14, standard bolt assembly 16, standard recoil spring assembly 18, including a spring 20, guide rod 22, and right-side charging handle 24. It also includes a standard buffer block 26, barrel 28, and V-block 30 with attachment bolts 32 for securing the barrel 28 to the receiver 10. The bolt 16 includes a transverse seat or slot 34 that removably receives and engages a portion of the charging handle 24. When assembled, rearward force on the charging handle 24 causes the bolt to retract and spring 20 to compress as an opposite end of the charging handle 24 slides along the guide rod 22. This construction, its assembly, and its manner of operation are well-known in the field.

Figure 2:
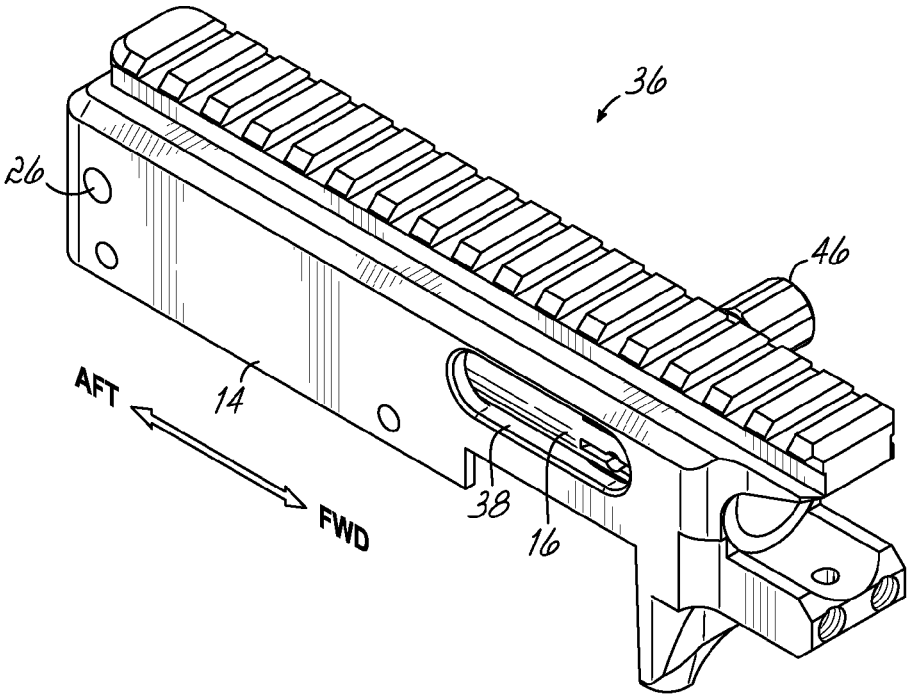
FIG. 2 is a right side isometric view of a receiver assembly according to an embodiment of the present invention.
Figure 3:
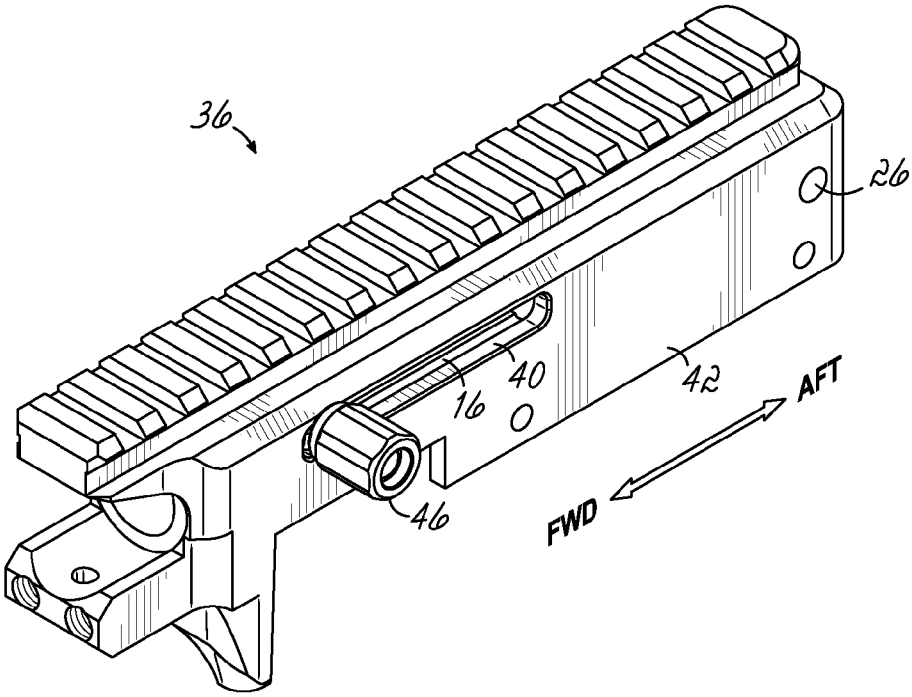
FIG. 3 is a left side isometric view thereof.

Referring now to FIGS. 2 and 3, therein is shown a preferred embodiment of a replacement receiver 36 having a reduced length ejection port 38 in the right side wall 14 and an elongated bolt handle reciprocation opening 40 provided in the opposite (left) side wall 42. The ejection port 38 is longitudinally shorter than the combined ejection port and handle slot 12 of the standard receiver 14. The opposite side bolt handle opening 40 significantly longer than the ejection port 38 and narrower in the vertical dimension.

The receiver 36 is configured at its forward end to accept and engage a standard Ruger 10/22® (or Charger™) barrel 28. The barrel 28 is secured to the receiver 36 by way of a standard retainer member or V-block 30 and attachment bolts 32 according to well-known practice. The bolt 16 used with this invention is "original" in that it is unchanged and interchangeable with a standard 10/22®-pattern bolt. The manner in which the bolt assembly 16 functions and interoperates with the barrel 28 is unchanged in any way from that provided in the standard Ruger 10/22® rifle or Charger™ pistol, other than the manner by which it is manually cycled, as described below.

Figure 4:
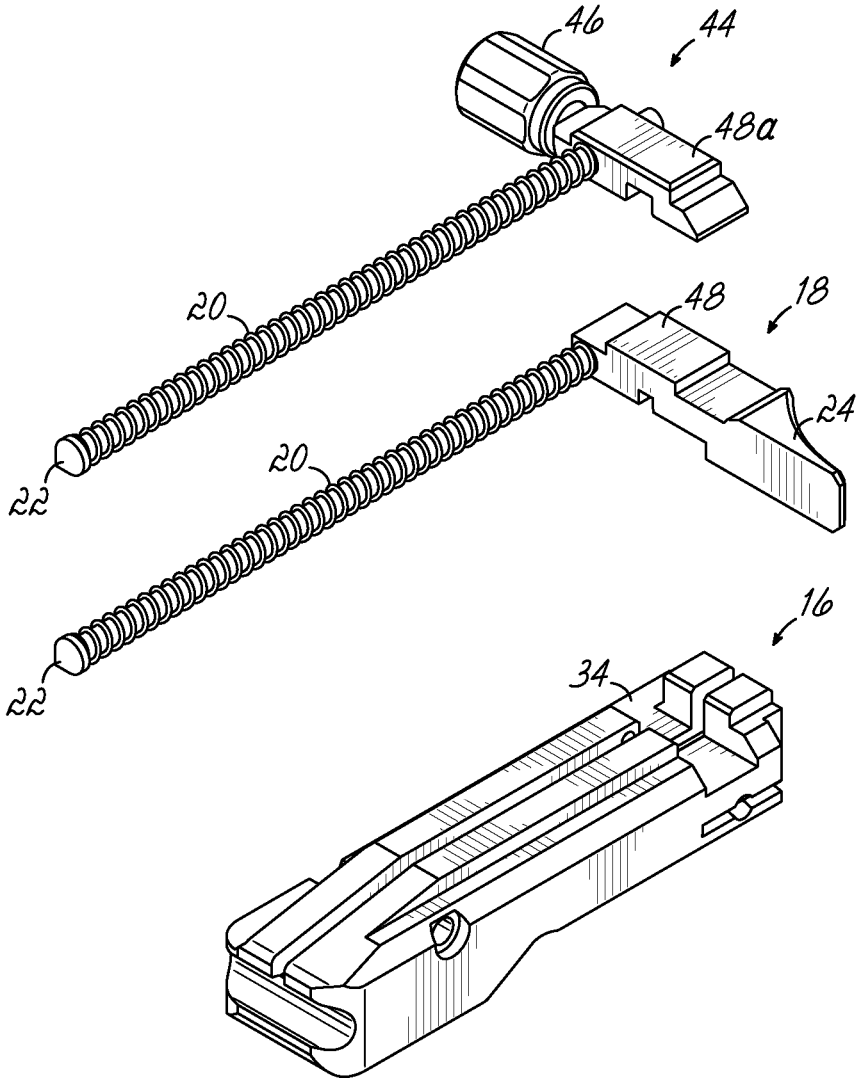
FIG. 4 is an exploded isometric view of the standard bolt along with and a standard recoil spring group and replacement recoil spring group for use with an embodiment of the present invention.

Referring now to FIG. 4, therein is seen an exploded view of the bolt assembly 16, standard recoil spring assembly 18, and a spring recoil assembly 44 modified according to an embodiment of the present invention to provide a left-side charging handle 46 that will extend through the left side bolt handle reciprocation opening 40. The recoil spring assembly 18, 44 includes the recoil spring 20, guide rod 22, and bolt engagement slider 48, 48*a*. For purposes of the present invention, the standard charging handle 48 and bolt engagement slider 48 is replaced with the bolt engagement slider 48*a* and a left-side charging handle or knob 46. In practice, the entire assembly 44 may be exchanged for the original assembly 18. Replacement of the entire assembly 18 eliminates the consumer having to disassemble and reassemble the recoil spring 20 and guide rod 22, two parts which are very low cost to replace.

Figure 5:
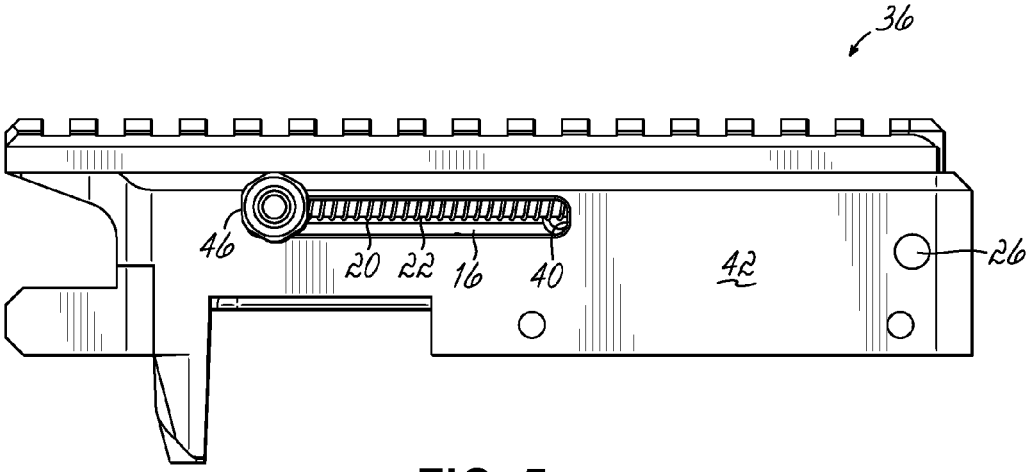
FIG. 5 is left side elevational view of a receiver assembly according to an embodiment of the present invention.
Figure 6:
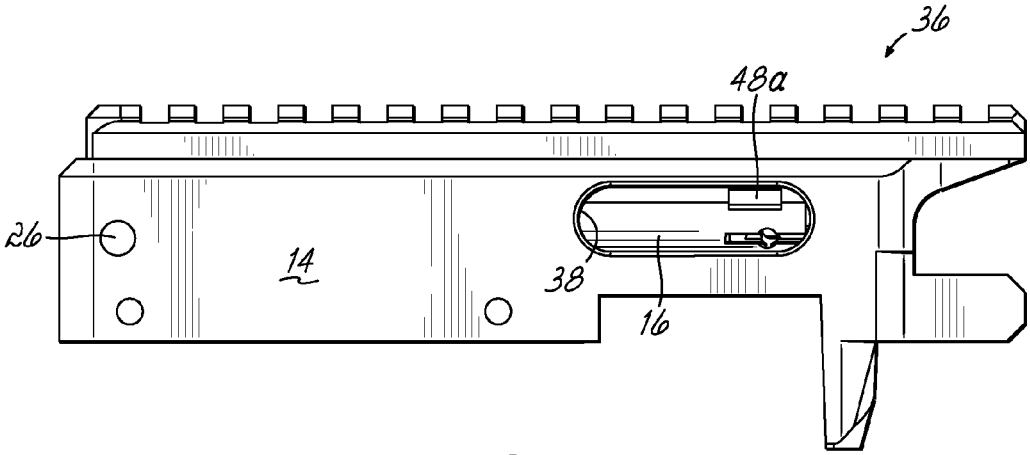
FIG. 6 is a right side elevational view thereof.
Figure 7:
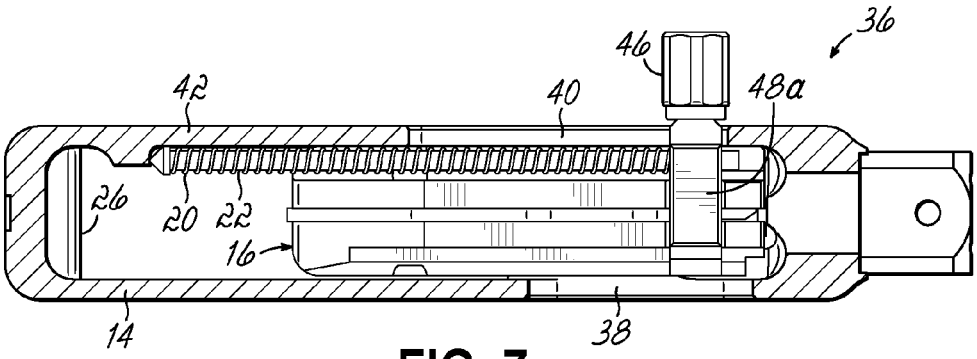
FIG. 7 is a top plan view of the assembly with a portion of the receiver cut away to show the bolt and recoil spring group assembled therein.

As seen in FIGS. 3, 5, and 7, the recoil spring 20 and guide rod 22 are positioned along the inside of the left side wall 42, which is unchanged from the standard location in the original Ruger 10/22®-pattern receiver 10. A portion of the spring 20 and guide rod 22 can be seen through the bolt handle reciprocation opening 40 when the bolt is in the forward, in-battery position, which allows for visual inspection and easy lubrication. Because the longitudinal axis of the guide rod 22 is positioned between the bolt engagement portion 48 and charging handle knob 46, lateral forces on the guide rod 22 when the charging handle 46, 48 and bolt 16 are manually cycled are significantly reduced.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm receiver and bolt operating assembly for use in combination with a standard bolt for a semi-automatic rim-fire firearm action, the original bolt operating assembly of the firearm having a laterally extending bolt operating handle that reciprocates with the standard bolt of the firearm and which extends through a side ejection port sized to accommodate reciprocation of the bolt operating handle, the said receiver and bolt operating assembly comprising:

a receiver housing configured to function with a reciprocating firearm bolt, said receiver housing having a first side and a second side opposite the first side, the first side including an ejection port which does not include a bolt handle reciprocation opening and the second side including an elongated charging handle slot;

a bolt closure mechanism adapted to bias the firearm bolt into battery, said mechanism comprising a guide rod having a stop at one end, a recoil spring positioned over said guide rod, and an engagement member slidably mounted over the other end of said guide rod such that movement of said engagement member toward said stop compresses said recoil spring, said engagement member having a portion adapted to be received in a transverse seat of the firearm bolt and providing a laterally extending bolt operating handle configured to extend through the elongated charging handle slot opposite the ejection port, the recoil spring and guide rod being positioned inwardly adjacent to the elongated charging handle slot and laterally between the bolt operating handle and the portion received in the seat of the bolt, wherein the recoil spring is at least partially visually exposed through the elongated charging handle slot when assembled in the receiver with the bolt.

2. The firearm receiver and bolt operating assembly of claim 1, wherein the elongated charging handle slot has a longitudinal length greater than that of the ejection port.

3. The firearm receiver and bolt operating assembly of claim 1, wherein the elongated charging handle slot extends to a rear end that is further aft than a rear end of the ejection port.

* * * * *